US006099300A

United States Patent [19]

Rice

[11] Patent Number: 6,099,300

[45] Date of Patent: Aug. 8, 2000

[54] EXTENDABLE SAFETY LIGHTER

[76] Inventor: Timothy P. Rice, 100 Marzia Del Rey, Madisonville, La. 70447

[21] Appl. No.: 09/395,029

[22] Filed: Sep. 13, 1999

[51] Int. Cl.[7] ..... F23Q 7/12

[52] U.S. Cl. ..... 431/255; 431/131; 431/264

[58] Field of Search ..... 431/255, 254, 431/256, 129, 132, 144, 344, 345, 131, 264; 126/25 B

[56] References Cited

U.S. PATENT DOCUMENTS

| | | | |
|---|---|---|---|
| D. 382,411 | 8/1997 | Ferrara, Jr. . | |
| 3,200,292 | 8/1965 | Owens et al. . | |
| 3,905,750 | 9/1975 | Sell | 431/344 |
| 4,292,021 | 9/1981 | Miyagawa . | |
| 4,538,983 | 9/1985 | Zeller et al. . | |
| 4,610,624 | 9/1986 | Bruhn . | |
| 5,199,865 | 4/1993 | Liang . | |

*Primary Examiner*—James C. Yeung
*Attorney, Agent, or Firm*—Joseph T. Regardd, Ltd.

[57] ABSTRACT

A gas fueled lighter having a compact storage configuration so as to be easily carried in a pocket or purse, the lighter actuated by sliding a longitudinal portion engaged to the body so as to extend said portion to form an extension having a free end, the free end configured to initiate a flame upon full extension from the body, the flame fueled by gas in the body and ignited by a piezo ignition switch. The preferred embodiment of the present invention is designed to provide an inexpensive, compact, easy to implement lighter providing the flame from an extension when in use, the extension sliding back to form a portion of the body when not in use. This safety feature not only provides a flame extended from the user's hand and body, it also provides an extension for lighting pilot lights, gas grills, fireplaces, and the like. The body of the preferred embodiment has a gas reservoir therein as well as the ignition and fuel valve, and further has a generally rectilinear configuration with at least a portion of the top configured to slide longitudinally to form the extension, the upper face of the top including a frictional area for placement of the user's thumb thereupon for sliding of the extension and initiation/cessation of the flame. The body may be rubberized for a better grip, and may include finger ridges for an enhanced grip of the system, and the overall body ideally has an ergometric design to facilitate comfortable and tactile operation.

13 Claims, 2 Drawing Sheets

EXTENDABLE SAFETY LIGHTER

TECHNICAL FIELD OF THE INVENTION

The present invention relates to lighters, particularly to a gas fueled lighter having a compact storage configuration so as to be easily carried in a pocket or purse, the lighter actuated by sliding longitudinal portion of the body so as to extend said portion to form an extension having a free end, the free end configured to initiate a flame upon full extension from the body, the flame fueled by gas in the body and ignited by a piezo ignition switch.

The preferred embodiment of the present invention is designed to provide an inexpensive, compact, easy-to-implement lighter providing the flame from an extension when in use, the extension sliding back to form a portion of the body when not in use. This safety feature not only provides a flame extended from the user's hand and body, it also provides an extension for lighting pilot lights, gas grills, fireplaces, candles, and other hard to reach areas.

The body of the preferred embodiment has a gas reservoir therein as well as the ignition and fuel valve, and further has a generally rectilinear configuration with at least a portion of the top configured to slide longitudinally to form the extension, the upper face of the top including a frictional area for placement of the user's thumb thereupon for sliding of the extension and initiation/cessation of the flame. The underside of the body may include finger ridges for an enhanced grip of the system, and the overall body ideally has an ergometric design to facilitate comfortable and tactile operation. Also, the overall body may be rubberized to provide an enhanced grip. Of course, alternatively, the body may be in the form of an elongated, elliptical cylinder, or other configuration.

BACKGROUND OF THE INVENTION

While pocket lighters have existed for over 100 years in various forms, there still exists a need for a compact, inexpensive gas lighter which may be easily and comfortably carried in one's pocket, yet provides an flame from an extension so as to facilitate easy and safe lighting of pilot lights, gas grills, fireplaces, candles, and even cigars, pipes and the like.

The prior art teaches various disposable gas lighters having a boom for lighting grills, fireplaces or the like, however, even the folding units are rather bulky to carry and awkward to use, and are not intended for carrying in ones pocket or purse.

A list of patents which may have some pertinence to the present invention include:

| Patent Number | Inventor | Date of Issue |
|---|---|---|
| 5,199,865 | Liang | 04/06/1993 |
| 4,610,624 | Bruhn | 09/09/1986 |
| 4,538,983 | Zeller et al | 09/03/1988 |
| 4,292,021 | Miyagawa | 09/29/1981 |
| 08/10/1965 | Owens et al | 08/10/1965 |
| Des 382,441 | Ferrara, Jr. | 08/19/1997 |

U.S. Pat. No. 4,538,983 teaches a "safety lighter" including a body having pivotally attached to one end an ignition extension, so as to allow the unit to be pivotally folded so as to be carried in a pocket, and while in the folded position, the actuation button is covered so as to prevent accidental ignition.

Pat. No. Des 382,441 and U.S. Pat. No. 5,199,865 teach other variations of the '983 patent, above.

U.S. Pat. No. 4,610,624 teaches a "Hand-Operated Gas Lighter" wherein the piezoelectric generator's ignition plunger is pressed via a trigger against a lever which serves to open the fuel supply valve, thereby simultaneously providing gas to the burner as well as an ignition spark via the piezoelectric generator.

The above cited prior art does not disclose, suggest, or otherwise contemplate a pocket lighter which is easily carried, while providing an extended flame, in a safe and readily implemented fashion.

GENERAL SUMMARY DISCUSSION OF THE INVENTION

The present invention provides a pocket lighter with a longitudinal, slide-actuated extension which simultaneously acts to initiate gas flow to the burner tip from the gas reservoir, and ignition via a piezo electric generator, thereby providing a lighter which is safer, easier to operate, and less expensive to purchase and utilize than the above prior art devices.

The preferred embodiment of the present invention is configured to initiate a flame upon full extension from the body, and retract to provide an enclosed body with no exposed triggers or other means to accidentally ignite the system.

The body of the preferred embodiment has a gas reservoir therein as well as the ignition and fuel valve, and further has a generally rectilinear configuration with at least a portion of the top configured to slide longitudinally to form the extension, the upper face of the top including a frictional area for placement of the user's thumb thereupon for sliding of the extension and initiation/cessation of the flame. The underside of the body may include finger ridges for an enhanced grip of the system, and the overall body ideally has an ergometric design to facilitate comfortable and tactile operation. Also, the overall body may be rubberized to provide an enhanced grip. Alternatively, the body may be in the form of an elongated elliptical cylinder or the like.

It is therefore an object of the present invention to provide a safety lighter having an extended ignition tip which may be compactly and conveniently carried in the user's pocket or purse.

It is another object of the present invention to provide a safety lighter which, in its compact storage configuration, is configured so that no trigger or other switch is exposed, so as to prevent accidental initiation of the system.

It is another object of the present invention to provide a safety lighter which is ergometrically designed for ease of initiation and use.

It is another object of the present invention to provide a safety lighter which provides an extendable/retractable ignition source which is slidingly attached to the body of the unit in longitudinal fashion.

Lastly, it is an object of the present invention to provide a method and system for providing an ignition source which is safer, easier to use, and more efficient in design and operation than prior art systems.

BRIEF DESCRIPTION OF DRAWINGS

For a further understanding of the nature and objects of the present invention, reference should be had to the following detailed description, taken in conjunction with the accompanying drawings, in which like parts are given like reference numerals, and wherein.

DETAILED DISCUSSION OF THE INVENTION

Figure 1:
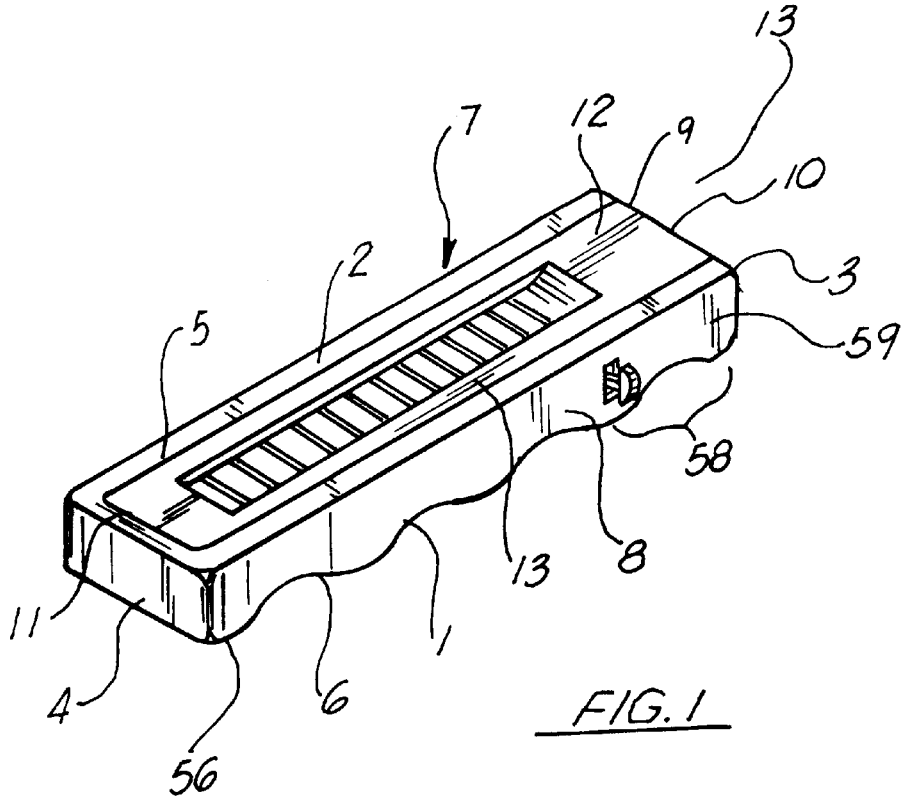
FIG. 1 is an isometric view of the preferred embodiment of the compact safety lighter of the present invention.
Figure 2:
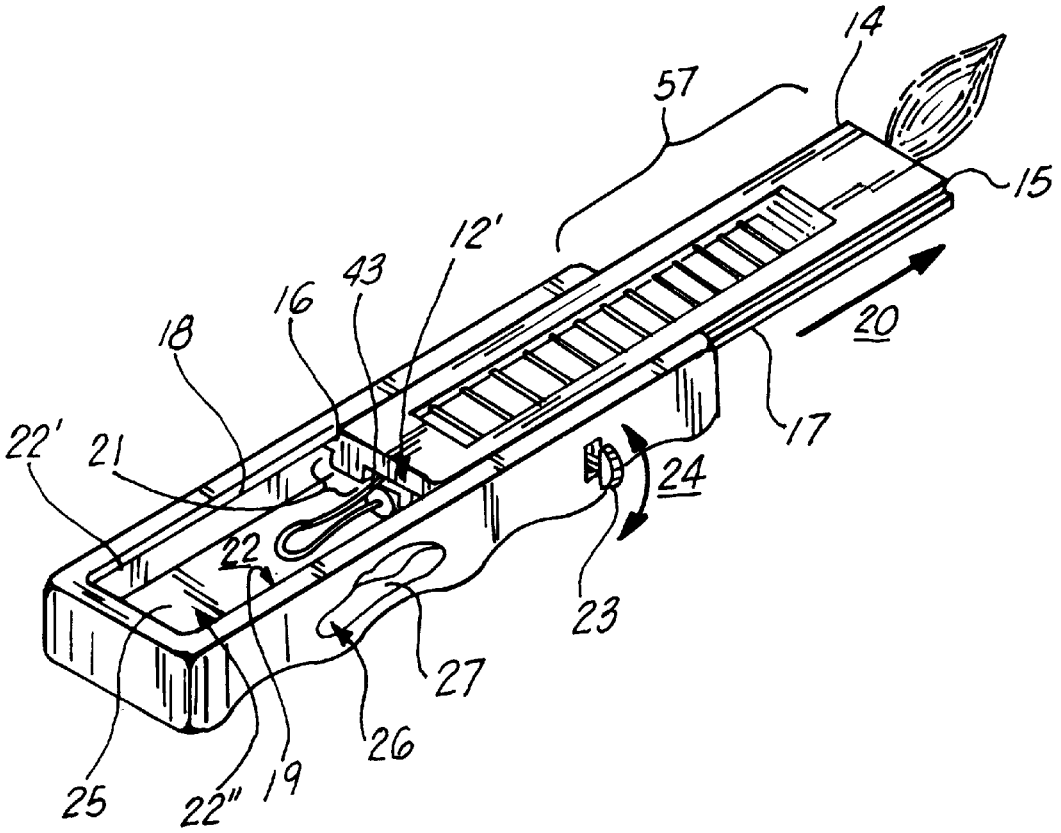
FIG. 2 is an isometric view of the invention of FIG. 1, illustrating initiation of the longitudinal burner extension, and initiation of a flame therefrom.

Referring to FIGS. 1 and 2, the device 1 of the present invention comprises a generally rectilinear configured body 2 having first 3 and second 4 ends, a top 5 and bottom 6, and first 8 and second 7 sides. As shown, the top has formed therein a compartment 22 which is covered by a slidingly engaged extension member 9. The extension member 9 is aligned with the longitudinal axis 13 of the body, the extension member 9 having first 10 and second 11 ends, a top face 12, a bottom face 12', and first 14 and second 15 edges, each edge having emanating therefrom connecting male edges 16, 17, configured to slidingly engage slots 18, 19, respectively, which slots are formed in the side walls 22', 22"of compartment 22, such that a user may grasp the body, placing the user's thumb upon gripping area 13 formed upon the extension member 9, and urge the extension member forward of the first end 3 of the body 2, extending 20 the extension member first end 10 from the body. As indicated, the body may also have other configurations, including that of an extended oval or elliptical cylinder.

The floor 25 of compartment 22 has situated thereunder, and within the body, a reservoir 26 for fuel 27, which fuel may comprise, for example, propane or the like.

Emanating from the bottom face 12' of the extension member 14 is an activation member 21, which is configured to activate the system when the extension member is fully deployed 57, as will be more fully discussed infra.

Figure 3:
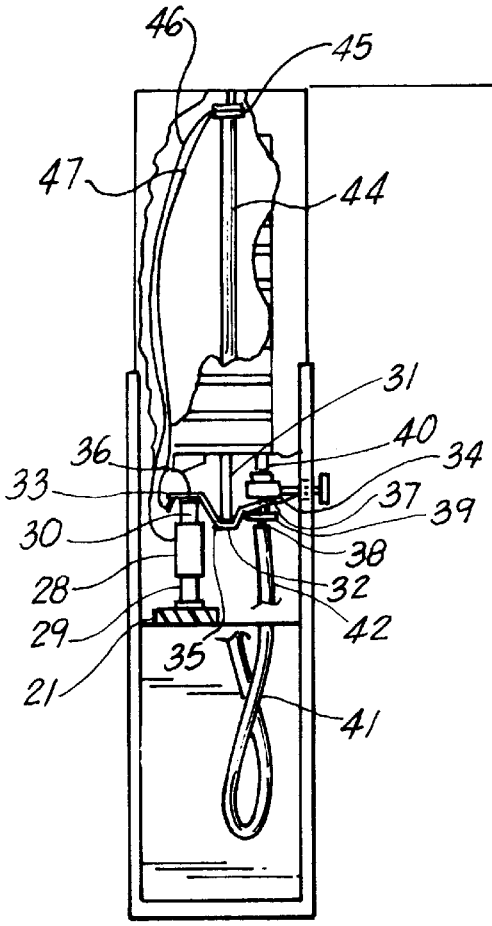
FIG. 3 is a cut-away view of the invention of FIG. 1, illustrating the operation of the invention of FIG. 1, illustrating initiation of the fuel source prior to ignition of the piezoelectric generator.
Figure 4:
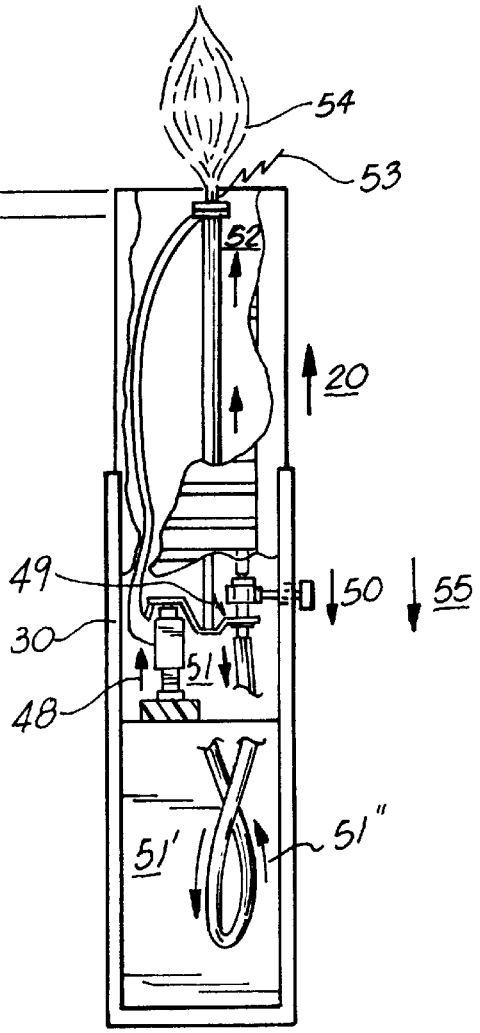
FIG. 4 is a cut-away view of the invention of FIG. 3, further illustrating ignition of the piezo electric generator and flame ignition from the burner tip of the extension.

Continuing with FIGS. 2–4, situated within compartment 22 and under extension member 9 is an exemplary activation means for activating the system.

As shown, a pivot bar 32 having first 33 and second 34 ends, with a medial area 35 therebetween, is provided. The back side of medial area 35 of the pivot bar communicates 36 with a pivotal support 31, as shown, while the front side of the first end 33 of the pivot bar 32 communicates with piezoelectric generator 28, which in turn communicates with activation member 21. the second end 34 of the pivot bar 32 communicates with gas valve 37 conduit 38 and lifting ring 39. The valve conduit 38 feeds fuel from a tube 40 to the fuel reservoir to a tube 41 having first 42 and second 43 ends, the first end communicating with the valve conduit, the second end communicating with a conduit 44 running through the extension member, terminating at a flame tip 45 at the first end of the extension member. Ignition wires 46, 47 may be run from the piezoelectric generator 28 to the flame tip 45 to ignite any fuel emanating therefrom.

In use, grasping the body of the device, with the user's thumb on the gripping area 13' formed in the top face of the extension member, the user slides the extension member forward, urging 20 the extension member so that the first end 10 is spaced from the body, until pressure from the activation member 21 forces the piezoelectric generator 28 against the first end 33 of pivot bar 32, the force 48 causing the pivot bar to pivot, lifting 50 the second end of the pivot bar and lifting 49 gas valve 37 conduit 38 via lifting ring 39, which is configured to open upon lifting of the shaft. The gas valve 37, which communicates with fuel reservoir 26, then allows the flow of fuel through the valve, through 51', 51" fuel tube 41, through 52 flame tip 45.

Continued pressure 48 upon the piezoelectric generator 28 via piece 29 communicating with activation member 21, causes plunger 30 to initiate 48, generating a spark 53 at the flame tip 45, igniting the fuel emanating from the flame tip, generating flame 54. Withdrawal 55 of the extension releases the pivotal lifting pressure 50 on the valve 37, causing a cessation of the fuel to the flame tip, and thereby ceases the flame. Further urging 55 of the extension member back to the body fully encloses 56 (FIG. 1) the device, which is then ready to be placed into the user's pocket. Lastly, the bottom of the body may have formed therein finger grips 58 to provide an ergometric feel, and the body may be rubberized or otherwise formed or coated with a material which enhances the gripping of the unit. Adjustment knob 23 is provided to pivotally 24 adjust gas flow through valve 37, so as to adjust flame height.

Unlike most lighters, which, for activation, rely upon a trigger or button to be pressed, or a wheel to be turned in order to release fuel or initiate the ignition, the present system has no trigger, button, or wheel, nothing to get caught upon, hang up on in the user's pocket or purse, and is thereby believed to be safer than prior art lighter designs or the like, being less likely to accidentally release fuel when compared to prior art systems.

The invention embodiments herein described are done so in detail for exemplary purposes only, and may be subject to many different variations in design, structure, application and operation methodology. Thus, the detailed disclosures therein should be interpreted in an illustrative, exemplary manner, and not in a limited sense.

What is claimed is:

1. A lighter, comprising:

a body having a longitudinal axis, first and second ends, a top and bottom, and first and second sides, said top of said body having first and second walls forming a compartment;

an extension member slidingly engaged to said body in the vicinity of the top of said body, said extension member aligned with said longitudinal axis said body, said extension member having first and second ends, a top face, a bottom face, and first and second edges, said first end of said extension member having a flame tip;

ignition means associated with said body to provide fuel and ignition to said first end of said extension member, said ignition means initiated by slidingly urging said first end of said extension member away from said first end of said body.

2. The lighter of claim 1, wherein said first and second edges of said extension member have emanating therefrom protrusions, said protrusions configured to engage longitudinally situated slots formed in said first and second walls forming the compartment.

3. The lighter of claim 1, wherein said ignition means comprises a pivot bar having first and second ends and a medial area therebetween, said pivot bar configured to pivot at said medial area, said pivot bar contacting at said one end of said pivot bar a pressure activated ignition source, said other end of said pivot bar contacting a fuel valve such that said fuel valve is opened so as to provide a flow of fuel therefrom prior to said pressure activated ignition source activating, said pivot bar, fuel valve, and pressure activated ignition source is situated in the compartment formed in said body.

4. The lighter of claim 3, wherein said ignition means further comprises an activation member protruding from said bottom face of said extension member into the compartment formed in said main body.

5. The lighter of claim 4, wherein said pressure activated ignition source comprises a piezoelectric generator having first and second ends, said piezoelectric generator initiated by a plunger, said first end of said piezoelectric generator communicating with said activation member, said second end of said piezoelectric generator communicating with said first end of said pivot bar, said fuel valve communicating with said second end of said pivot bar.

6. The lighter of claim 5, wherein said top face of said extension member has a gripping area formed thereupon.

7. The lighter of claim 6, wherein said bottom of said lighter has formed therein finger grips.

8. The lighter of claim 7, wherein said bottom of said body includes finger grips.

9. The lighter of claim 8, wherein said body has a generally rectilinear configuration.

10. The lighter of claim 9, wherein said body has applied thereupon a frictional coating.

11. The method of providing a flame, comprising the steps of:

a. providing a lighter comprising:

a body having a longitudinal axis, first and second ends, a top and bottom, and first and second sides, said top of said body having first and second walls forming a compartment;

an extension member slidingly engaged to said body in the vicinity of the top of said body, said extension member aligned with said longitudinal axis said body, said extension member having first and second ends, a top face, a bottom face, and first and second edges, said first end of said extension member having a flame tip;

ignition means associated with said body to provide fuel and ignition to said first end of said extension member, said ignition means initiated by slidingly urging said first end of said extension member away from said first end of said body;

b. grasping the body;

c. slidingly urging said first end of said extension member away from said first end of said body;

d. upon said first end of said extension member reaching a predetermined distance from said first end of said body, further urging said extension member so as to initiate said ignition means;

e. first initiating a flow of fuel to said flame tip;

f. second initiating an ignition source at said flame tip while said fuel continues to flow;

g. igniting said flame;

h. utilizing said flame;

i. slidingly urging said first end of said extension member towards said first end of said body; while j. ceasing flow of said fuel, so as to extinguish said flame.

12. The lighter of claim 11, wherein said step "e" of initiating a flow of fuel comprises the step of utilizing an activation member situated on the underside of said extension member to force a piezoelectric generator against one end of a pivot bar, raising the second end of said pivot bar, said second end of said pivot bar initiating a fuel valve to release fuel to said flame tip.

13. The lighter of claim 12, wherein said step "f" of initiating an ignition source comprises the step of, after initiating said fuel valve, providing force to said extension member so as to force said activation member against said piezoelectric generator, so as to initiate same, so as to provide a spark to said flame tip, so as to ignite fuel flowing therefrom.

* * * * *